US005201959A

United States Patent [19]

Fuller

[11] Patent Number: 5,201,959

[45] Date of Patent: Apr. 13, 1993

[54] APPARATUS FOR DYEING CARPET

[76] Inventor: Benjamin F. Fuller, 9729 Mountainair Dr., Oottewah, Tenn. 37363

[21] Appl. No.: 837,651

[22] Filed: Feb. 14, 1992

Related U.S. Application Data

[60] Continuation-in-part of Ser. No. 672,349, Mar. 20, 1991, abandoned, which is a division of Ser. No. 561,161, Aug. 1, 1990, abandoned.

[51] Int. Cl.[5] ..... D06B 3/10; D06B 23/14

[52] U.S. Cl. ..... 68/9; 68/15; 68/19.1; 68/20; 68/175; 68/207

[58] Field of Search ..... 8/158, 929, 930, 932, 8/934; 68/5 E, 9, 15, 19.1, 20, 175, 207

[56] References Cited

U.S. PATENT DOCUMENTS

| | | | |
|---|---|---|---|
| 2,387,200 | 10/1945 | Walter | 68/9 X |
| 2,669,502 | 2/1954 | Walmsley | 68/175 X |
| 3,722,233 | 3/1973 | Windhorst | 68/5 |
| 3,776,005 | 12/1973 | Rogers | 68/5 |
| 3,788,811 | 1/1974 | Sievenpiper et al. | 8/175 |
| 3,922,738 | 12/1975 | Holm | 68/19.1 X |
| 3,986,831 | 10/1976 | von der Eltz et al. | 68/5 E X |
| 4,447,924 | 5/1984 | Bolton et al. | 68/19.1 X |
| 4,578,836 | 4/1986 | Otting et al. | 8/151 |
| 5,010,613 | 4/1991 | Driesen et al. | 8/158 X |

FOREIGN PATENT DOCUMENTS

| | | | |
|---|---|---|---|
| 242790 | 11/1925 | United Kingdom | 68/19.1 |
| 1241820 | 11/1968 | United Kingdom . | |
| 2063943 | 6/1981 | United Kingdom | 68/5 E |

*Primary Examiner*—Philip R. Coe

*Attorney, Agent, or Firm*—Hurt, Richardson, Garner, Todd & Cadenhead

[57] ABSTRACT

A method and apparatus which utilizes a novel dye solution for dyeing carpet in which the dye solution is heated to a temperature higher than the boiling point of water thus allowing fixation of the dye on the carpet without the need for a steam fixator.

13 Claims, 1 Drawing Sheet

APPARATUS FOR DYEING CARPET

This is a continuation-in-part of copending application Ser. No. 07/672,349 filed on Mar. 20, 1991, which is a divisional of copending application Ser. No. 07/561,161 filed on Aug. 1, 1990, both now abandoned.

BACKGROUND OF THE INVENTION

1. Field of the Invention

This invention relates to the dyeing of carpets and, more particularly, to a apparatus for dyeing carpets which, through the use of a dye bath which has a much higher boiling point than water, does not require the steaming of the carpet to set or fix the dye to the carpet.

2. Prior Art

Currently known and used methods and apparatuses for dyeing carpet require the steaming of the carpet to set or fix the dye to the carpet after the dye has been applied to the carpet. For example, the typical carpet dyeing method and apparatus involves the application of a dye to the pile surface of the carpet, fixing the dye onto the carpet pile by steaming and then subjecting the carpet to various other finishing procedures prior to drying the carpet.

Once such conventional carpet dyeing process is disclosed in U.S. Pat. No. 4,101,270. This patent discloses a method for dyeing carpet which includes the steps of advancing a continuous textile web through a preshrinking station, moistening the textile web, dyeing the textile web using applicator rolls and/or dye applicators, and then fixing the dye onto the textile web by passage through, for example, a chamber containing steam. This basic method generally forms the base for the other prior art carpet dyeing systems and is well known in the art.

Likewise, a second example of a carpet dyeing process including a steam fixator is disclosed in U.S. Pat. No. 4,771,497. This patent discloses a process for the continuous treatment of a textile web material involving the application of a dye to the pile surface of the carpet and then initiating the dye fixation onto the pile surface by steaming. Many of the prior art patents such as the two disclosed above involve such a steam fixation process and are distinguishable from each other by various additional, optional processes added onto this base dyeing technique.

The patent issued to Walter, U.S. Pat. No. 2,387,200, discloses and claims a method for dyeing material which is carried out in a sealed chamber, namely a closed chamber incorporating compressed air and saturated steam. The '200 method is carried out at a temperature substantially above 212° F. and under pressure. Therefore, the '200 method incorporates by its nature a steam fixation step as when the material emerges from the dye bath which is heated substantially above 212° F., it encounters compressed air and saturated steam under pressure, which is the equivalent of a steam fixation step. The apparatus of the present invention is not a closed or sealed chamber, but is open to the atmosphere, and does not use water-based dye baths or steam, thus eliminating the steam fixation step which can cause uneven dyeing and running of the dye. Further, the use of an open chamber and lower overall temperatures, namely typically between 212° F. and 240° F., allows the present invention to be much more economical in terms of energy costs and apparatus material costs.

The method disclosed in the '200 patent also does not comprise a separate, independent material preheating step, nor the means for carrying out such a separate, independent material preheating step. The material to be dyed in the '200 method is introduced to the pressure chamber and almost immediately submerged into the dye bath. Although the material to be dyed encounters elevated temperatures upon being introduced to the pressure chamber, no specific control or methodology is present to constitute a preheating step or means. In the present invention, a separate, independent preheating step accomplished by a separate, independent preheating means is carried out on the material to be dyed prior to the introduction of the material to be dyed to the main dye bath. The controlled preheating of the material to be dyed to a temperature near or at the temperature of the dye bath helps to reduce the dye application time and the heat loss from the dye bath which would occur if the material to be dyed needed to be heated to the temperature of the dye bath during the dyeing process. Such a separate, independent preheating step and means, which may utilize the same heat source as the dye bath, has economic advantages over prior art processes, such as that disclosed in the '200 patent.

The patent to von der Eltz et al., U.S. Pat. No. 3,986,831, discloses and claims a high temperature, high pressure batch process for dyeing materials which incorporates a pressure vessel and high-pressure steam fixation. The '831 apparatus and method operate in an essentially air-free environment. Further, the dye fixation disclosed in the '831 patent occurs at a temperature over about 255° F., creating the need for significant energy input. Likewise, the patent to Blount, U.S. Pat. No. 3,418,065, discloses and claims a high temperature, high pressure batch process which also is carried out in a sealed pressure chamber not open to the atmosphere and which incorporates a steam fixation step. On the contrary, the present process and apparatus are open to the atmosphere and do not involve the use of steam or steam fixation. The present process is a continuous process which is carried out on a continuous-running apparatus. Further, the entire process of the present invention can occur at a temperature of between 212° F. and about 240° F., significantly reducing the energy costs and the apparatus costs.

The disadvantages of such prior art carpet dyeing methods and apparatuses which incorporate steam fixation components is the necessity for the steam fixation step. Steam fixation has several disadvantages including the need for a tremendous amount of energy required to heat the steam, dilution of the dye as the steam condenses into water and mixes with the dye, and the cost of the equipment, both in material and time, needed to have a steam fixation step in the carpet dyeing process. A further disadvantage is that a carpet dyeing process including a steam fixation step is uneconomical to operate when dyeing small batches of carpet.

The development of the open-to-the atmosphere process and apparatus also allows for the dyeing of materials at significantly lower energy costs and with a higher degree of safety. Less energy is necessary as there are no materials to be superheated and no pressure needs to be created. Materials costs are reduced as vessels open to the atmosphere typically do not need the reinforcing required for a pressure vessel. Lastly, pressure operations typically inherently are more dangerous than an equivalent atmospheric operation.

SUMMARY OF THE INVENTION

In accord with this invention, a more efficient, less costly carpet dyeing apparatus is disclosed. This invention may be used to dye carpets as well as all types of yarns, fibers, woven fabrics, knits and other fabric type materials made from, for example, nylon, polyester, wool, cotton, rayon and acrylics. This invention continuously dyes carpet without steaming by the use of a high temperature dye bath, fed at a specific temperature and flow rate to an applicator, in which the level and the temperature of the dye are controlled.

This invention comprises a novel dye bath applicator which effects the carpet dyeing and fixing step by utilizing a high temperature dye mixture, the temperature of which is higher than the boiling point of water the apparatus of this invention is open to the atmosphere and does not constitute a pressure vessel in the sense disclosed in prior art dyeing apparatuses. By eliminating the need for pressure vessel-type couplings and materials, the apparatus of this invention is both much less costly and safer to operate. The apparatus of this invention also generally comprises a preheater which effects the preheating step, a heated mix tank which effects the heating step of the dye and chemicals, a heat exchanger which effects the step of heating the dye prior to the dye entering the applicator, a vacuum extractor which effects the step of recovering the excess dye and returning it to the heat exchanger, and wash boxes with overflows which effect the step of neutralizing the pH of the carpet and washing the carpet before the carpet enters the drying stage.

This invention eliminates the need for a steam fixator by preheating the dye to a temperature above the boiling point of water and applying it to a preheated textile web. A unique mixture of chemicals allows the dye to be heated above the boiling point of water in this invention such that the dye is fixed onto the carpet pile during the dyeing step, therefore eliminating the need for a steam fixator after the dye application step.

There are numerous advantages to the novel apparatus of this invention. Some of these advantages include the elimination of any steam necessary in the dye fixation process, the elimination of the need for gum or thickeners, the elimination of the need for defoamers, and the reduction in the amount of pollutants emanating from the system. Other advantages include the elimination of dye or chemical waste, no increase in chemical and dyestuff content, and the need for less water usage in the system, which water can be recycled. Further advantages of this invention include a more uniform dye application to the carpet from the side to the center to the side of the carpet, better carpet definition, a less expensive dye machine, and the need for less dye space for the dye applicator.

Many conventional dye applicators or machines can be converted inexpensively to the method and apparatus of the present invention. Additionally, the apparatus of the present invention can dye a single strand of carpet yarn or a twelve foot (12') wide piece of carpet or wider, or any carpet size in-between, in a level configuration. It also is economical to dye small dye lots in the present invention as the dye beck time is reduced significantly compared to the prior art. Furthermore, the preheater used in this invention is heated from the heating system used to heat the dye bath applicator, thus saving significantly on heating costs throughout the system.

Accordingly, it is an object of the present invention to provide a carpet dyeing apparatus which eliminates the need for a steam fixation apparatus and step.

It is another object of the present invention to provide a carpet dyeing apparatus which has lower costs than conventional carpet dyeing methods and apparatuses, including lower power costs, lower machine costs, lower materials costs, and lower operating costs.

It is a further object of the present invention to provide a carpet dyeing apparatus which eliminates the need for gums, thickeners, and defoamers.

It is yet another object of the present invention to provide a carpet dyeing apparatus which has no dye or chemical wastes and has no increase in chemical and dyestuff content.

It is still another object of the present invention to provide a carpet dyeing apparatus which gives a more uniform dye application from side to center to side and which gives better carpet definition.

It is a still further object of the present invention to provide a carpet dyeing apparatus which utilizes a less expensive dye machine, takes up less floor space for the dye applicator and uses less water and recycles the water which it uses.

It is another object of the present invention to provide a carpet dyeing apparatus which can dye a single strand of carpet yarn all the way up to a twelve foot (12') wide or wider piece of carpet and which is economical to operate when dyeing small dye lots.

It is yet another object of the present invention to provide a carpet dyeing apparatus in which the preheater is heated from the heater unit used to heat the dye bath applicator.

It is also an object of the present invention to provide a unique dye solution which can be heated above the boiling point of water and can be fixed to a textile web without the need for steam fixation.

These and other objects of the invention will become apparent to those skilled in the art upon reading the following detailed description of the invention taken in conjunction with the following drawing in which like characters of reference correspond to like parts.

DETAILED DESCRIPTION OF A PREFERRED EMBODIMENT

Figure 1:
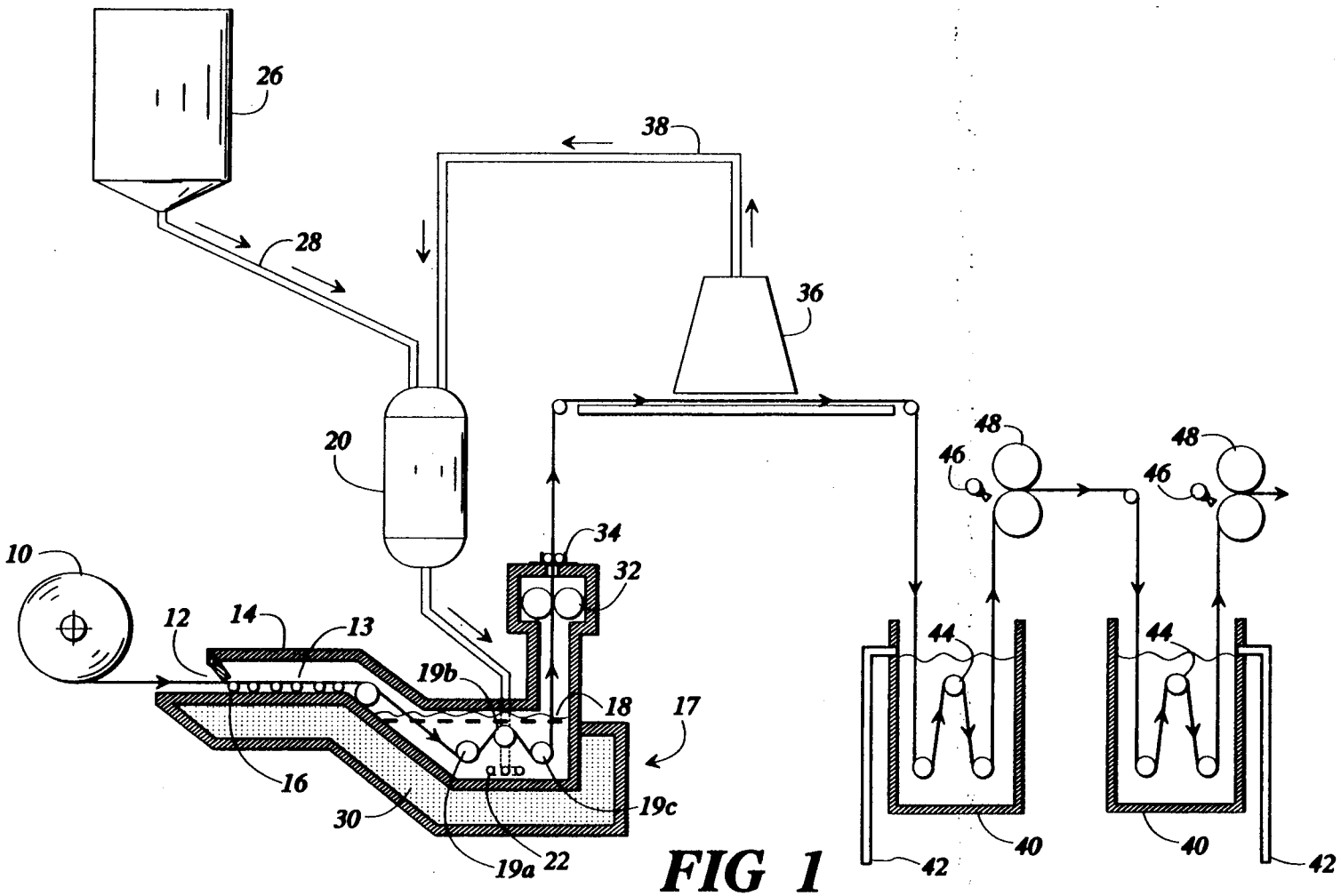
FIG. 1 is a schematic of the apparatus of the present apparatus.

A general schematic of the apparatus of the present invention showing the various components is shown in FIG. 1. In general, this invention, using a novel dye solution comprising dye, various chemicals as dye assistants and water, utilizes a dye solution which has a much higher boiling point than water. This higher boiling point dye solution is used as a bath to dye carpet. This bath is the main aspect that makes this invention unique from conventional methods of dyeing carpet. The term carpet is used in this disclosure to cover all fabrics, yarns and textile webs and is not meant to be limited to conventional carpeting as known in the art.

In this invention, carpet is colored by the dye in the higher boiling point bath. The higher boiling point dye bath allows the dye to be fixed to the carpet at that step, thus eliminating the need for a steam fixator. Additionally, the higher boiling point bath is heated in a novel and unique way as compared to the method for heating conventional dye baths. For example, the bath is heated by electric coils or elements or, alternatively, with an enclosed steam system to a temperature greater than the boiling point of water, a temperature which cannot be obtained in conventional systems. The method of heating also provides a more direct heat source.

The presence of a steam fixator causes a dilution of the dye solution. Therefore, the elimination of the steam fixation step also is important to the invention because the dye solution contains a given concentration of dye, chemicals, and water and any dilution of this solution may affect both the coloring of the carpet and the ability of the dye to be heated above the boiling point of water. As the carpet leaves the dye bath, the carpet is squeezed to remove excess dye, which dye is recycled to the dye bath. Then the carpet enters a cold water bath in which they dyeing process is stopped or fixed. Once the dye is fixed, normal variations in color in the carpet from side to center to side do not occur, as is common in continuous dyeing with a steam fixation step. The carpet is then rinsed in one or more wash boxes with overflow.

Referring now to FIG. 1, the dye solution utilized in this invention is stored in a dye vat 26. The dye solution utilized in this invention is a unique mixture of specific dyes, chemicals and water. In general, dye solutions are formed by dissolving dyes in a portion of the water to be used in the dye bath 18. Dyeing assistants and an acid to control the pH of the dye solution then are dissolved in the balance of the water to be used in the dye bath 18. The dissolved dye and the dyeing assistants and acid then are combined and mixed with a quantity of glycol. The glycol increases the boiling point of the dye solution to a temperature above the boiling point of water. This dye solution is heated to a temperature just below the boiling point of the dye solution, which, due to the mixture of components in the dye solution, is higher than the boiling point of water, and is applied to the carpet 10 in the dye bath applicator unit 17, as described more fully below.

Many mixtures of dye, chemicals and water may be made depending upon the dye desired. Useful dyes include, for example, acid dyes, disperse dyes, direct dyes, basic dyes, vats dyes fiber reactive dyes, and any other dyes that can be applied hot to a substrate. Two examples of representative dye solutions are as follows:

EXAMPLE 1

| Component | Percent by Weight | Grams/Liter |
|---|---|---|
| Dyes (selected acid dyes) | XX.X | X.XX |
| Benzyl Alcohol (747-Alcohol, DEG Glycol, Anonic and Nonic Surfactant) | 0.2 | 2.00 |
| Fulgen SDM (Ethoxylated C12–C15 Primary Alcohol and Coconut Condensate) | 0.2 | 2.00 |
| Sulfamic Acid, 15% sol. | 1.0 | 10.00 |
| Water | 23.6 | 316.00 |
| Subtotal of Dye | 25.0% | 330.00 |
| Diethylene Glycol (sp. gr. 1.12) or other types of Glycol | 75.0 | 670.00 |
| TOTAL | 100.0% | 1000.00 |

As described above, the selected acid dyes are first dissolved in a portion of the 316.00 g (or 316 ml) of water great enough to allow for the dissolution of the dyes. The dyeing assistants, such as benzyl alcohol and Fulgen SDM, and an acid to control pH, such as sulfamic acid, are then added to the dye/water mixture. These then are combined and mixed with the diethylene glycol or other glycol, which previously has been mixed with the remainder of the 316.00 g of water, to form the dye solution. The boiling point of this specific dye solution is approximately 228°–230° F. This specific dye solution is particularly useful for nylon tufted carpet or other nylon fabrics.

EXAMPLE 2

| Components | Percent by Weight | Grams/Liter |
|---|---|---|
| Dyes | XX.X | X.X |
| Fulpon GP (Potassium Salt of Ethoxylated Phosphate Alcohol) (Phosphated DA-4) | 0.2 | 2.0 |
| Water | 10.0 | 130.0 |
| Fulpal ME Anionic Surfactant (P-NP-9) | 0.5 | 5.0 |
| Sulfamic Acid, 15% sol. | 0.5 | 5.0 |
| Water | 13.8 | 188.0 |
| Subtotal of Dye | 25.0% | 330.0 |
| Diethylene Glycol or other Glycol | 75.0 | 670.0 |
| TOTAL | 100.0% | 1000.0 |

As in Example 1, the dye first is dissolved in a portion of the water great enough to allow for the dissolution of the dye. The water for this specific dye should be hot and a dispersing agent, such as the Fulpon GP, generally is needed to assist in complete dissolution. A leveling agent, such as Fulpal ME, and an acid to control the pH, such as sulfamic acid, is then added to the dye/water mixture. This solution is combined and mixed with a glycol, which previously has been mixed with the remainder of the water, to increase the boiling point of the dye solution. The boiling point of this specific dye solution also is approximately 228°–230° F. This specific dye solution is particularly useful for polyester carpet or other fabrics.

Any glycol which allows heat transfer is suitable for the dye solution. The appropriate dying assistants are selected so as to complement the fiber being dyed. That is, certain fibers dye better when certain dyeing assistants are used, as is known in the art. Anionic, nonionic, cationic, wetters, levelers, and retarders are all suitable dyeing assistants which are chosen according to the fiber being dyed. Although most any acid is appropriate to add to the dye solution, the most suitable acids include formic, sulfamic, citric, acetic and phosphoric, as well as acid generators.

The carpet, indicated generally by carpet roll 10, first enters a preheater 14 before it enters the dye bath applicator unit 17. The preheater 14, which generally is an extension of the dye bath applicator unit 17, generally comprises an entrance door 12, a preheating chamber 13 and transport rollers 16. The entrance door 12 generally is a spring loaded door, or a door with one way hinges, opening toward the interior chamber 13 of the preheater so as to minimize heat loss from the preheating chamber 13 through the door 12 into the atmosphere. The preheater 14, as well as the entire dye bath applicator unit 17, is open to the atmosphere. Door 12, being a spring loaded door, and exit rollers 34, to keep the carpet 10 travelling through the apparatus, do not create a pressure seal. Additionally, the dye bath applicator unit 17 is not enclosed in a pressure vessel, as are current carpet dyeing apparatuses. The carpet 10 is supported by roller 16 as the carpet 10 travels through the preheater 14. The purpose of roller 16 is to support and spread the carpet 10 as it enters the dye bath applicator unit 17, in order to avoid wrinkles in the carpet 10 and to prevent uneven dyeing.

The purpose of the preheater 14 is to heat the carpet 10 prior to the carpet 10 entering the dye bath applicator unit 17. Preheating of the carpet 10 keeps the dye bath 18 from cooling down and helps open dye sites on the carpet 10 so that the carpet 10 will be ready to take the dye from the dye bath applicators 19. The preheater 14 and preheating chamber 13 are heated using the same heating system 30 that heats the dye bath applicator unit 17. The heat system 30 may be any conventional heat system, such as electric coils or enclosed steam. The preheater 14 heats the carpet 10 to any selected temperature up to about 220° F.

The carpet 10 exits the preheater 14 and enters the dye bath applicator unit 17. The dye bath applicator unit 17 generally comprises dye bath 18, dye applicators 19*a*, 19*b*, 19*c*, dye entrance ports 22, squeeze rollers 32, and exit rollers 34.

The dye solution is supplied to the dye bath applicator unit 17 through dye solution entrance ports 22. The dye solution, upon leaving dye vat 26, is introduced through feedline 28 to a heat exchanger 20. The heat exchanger 20, which can be any conventional heat exchanger unit, is used to heat the dye solution to a high temperature, generally to any temperature up to about 240° F., prior to the dye solution entering the dye bath 18 and the dye bath applicators 19*a*, 19*b*, 19*c*. A flow meter (not shown) is located between the heat exchanger 20 and the dye bath application unit 17 so as to regulate the flow of the dye solution to the dye bath 18 so as to keep the level of the dye bath 18 constant.

In the dye bath applicator unit 17, the carpet 10 passes through high temperature dye bath applicators 19*a*, 19*b*, 19*c* which apply the dye solution to the carpet 10. In the dye bath applicator unit 17, the dye is further heated to between about 160° F. and about 240° F. The carpet 10 and the dye bath applicators 19*a*, 19*b*, 19*c* are submerged within the dye bath 18 facilitating in the even application of the dye to the carpet 10. The carpet 10 is threaded under first applicator roller 19*a*, over second applicator roller 19*b*, and over third applicator roller 19*c* to ensure even and thorough dye application. In the dye bath application unit 17, the carpet 10 is submerged in the dye bath 18 as it passes under, over, and under the applicator rollers, 19*a*, 19*b*, 19*c*, respectively.

After the dye solution has been applied to the carpet 10, the carpet 10 leaves the dye bath 18 and passes through squeeze rollers 32 to remove excess dye solution. The squeeze rollers 32 are located above the dye bath 18 such that any excess dye solution squeezed from the carpet 10 falls back into the dye bath 18 in a recycle fashion. After having the excess dye solution squeezed from the carpet 10 by the squeeze rollers 32, the dyed carpet exits the dye bath applicator unit 17 through exit rollers 34 which serve to remove some excess dye solution and to prevent heat loss from the dye bath applicator unit 17. Squeeze rollers 32 function to remove excess dye from the dyed carpet 10 and are located within the extended dye bath applicator unit 17. Exit rollers 34 typically are constantly moving rollers which function to keep the carpet 10 moving continuously at a desired rate through the apparatus such that the method can be carried out. The nature of the rollers 34 and the carpet 10 is such that this type of of roller 34 does not squeeze the carpet 10 to such an extent so as to create a pressure seal within the extended dye bath applicator unit 17. As any width of carpet 10 may be dyed in the present apparatus using the present method, and rollers 34 are constant width, there typically will be space between the edges of the carpet 10 and the edges of the rollers 34 such that the dye bath applicator unit 17 is open to the atmosphere via these and other spaces. Thus, pressure build-up within the dye bath applicator unit 17 is prevented.

The dyed carpet 10, which may still contain excess dye solution from the dye application process, next passes through a vacuum extractor 36. The vacuum extractor 36 is a conventional unit which further removes excess dye solution from the dyed carpet 10 through a vacuum means. Any excess dye solution removed from the carpet 10 by the vacuum extractor 36 is returned to the heat exchanger 20 through recycle line 38. The excess dye solution, therefore, is recycled back to the dye bath applicator unit 17 for dyeing further carpet.

The dyed carpet passes from the vacuum extractor 36 to one or more wash boxes 40. The purpose of wash box 40 is to wash off excess dye solution and chemicals, and to clean the carpet from any other debris which may have been picked up during the dyeing process. The wash box 40 uses a cold water bath with a neutral pH for the cleaning purpose. A further effect of the cold water bath is to aid in halting the dyeing process and to aid in fixing the dye on the carpet 10 surface.

In operation, the carpet 10 travels between one or more rollers 44 in the wash box 40 to increase the amount of time the carpet is in the cold water bath. Upon leaving the wash box 40, the carpet 10 passes by a spray washer 46 which also acts as the water introduction unit to the wash box 40. After being sprayed with cold water by the spray wash 46, the carpet 10 passes through squeeze rollers 48 to remove excess water. In some applications, it is advantageous to have a plurality of wash boxes 40 which generally are identical with each other. Each wash box 40 also is equipped with an overflow 42 to maintain a constant level of water in the wash box 40. After leaving the wash box 40, the carpet 10 is dried in a conventional manner, using conventional carpet drying apparatus.

The above process when applied with the appropriate apparatus will dye nylon, polyester, cotton, wool and other fibers utilizing acid, disperse, direct and basic class dyestuffs. The above process when utilized with the appropriate apparatus also accomplishes currently acceptable fastness and crocking performance levels with no steamer unit or other steam requirement for satisfactory color setting. Furthermore, the process of this invention when utilized with the appropriate apparatus achieves near 100% exhaustion of the dye solution and reduces affluent waste in the dye process by approximately 75% and is applicable to certain existing equipment upon modification of that equipment. When the carpet 10 comes out of the dye bath 18, the color shade is fully developed and will not continue to build in color department. Further, the water used in the wash box 40 can be recycled with simple plumbing additions (not shown).

The apparatus of the present invention can be retrofitted to most existing carpet dyeing equipment of the continuous range variety. The primary change would be to install the dye bath applicator 17 in line with the existing equipment. The existing steamer can be removed from the existing equipment as it is no longer needed, and the dye bath applicator 17 may be installed in its place. Alternatively, the dye bath applicator 17 may be placed immediately before the existing steamer with the carpet 10 first traveling through the dye bath applicator 17, then through the existing steamer, then to the carpet washing system. If this alternative is utilized, the existing steamer need not be turned on as it is unnecessary. Likewise, the dye bath applicator 17 may be placed immediately after the existing steamer with similar results.

This invention can be applied to all continuous dye ranges for carpet dyeing and to all forms of yarn dyeing such as, for example, warp, skein and knit-deknit space dyeing. This invention produces superior side to side color matching on continuous dye ranges and produces improved tuft definition and hand in saxony and velvet cut pile constructions. Furthermore, this invention has no practical limitation on speed other than the equipment speed limitations. Carpet dyed by the present process and apparatus displays superior color characteristics when compared to carpets dyed by conventional dye becks and continuous ranges.

It will be obvious to those skilled in the art that many variations may be made in the embodiment chosen for the purpose of illustrating the best mode of this invention without departing from the scope thereof as defined by the appended claims.

I claim:

1. An apparatus for dyeing fabric materials in which steam fixation of the dye onto the fabric materials is unnecessary, comprising:

a. a dye bath means containing a dye;

b. a heating means which heats the dye to a temperature higher than 212° F. at standard temperature and pressure;

c. a dyeing means for applying the dye to the fabric materials;

d. a removal means for removing excess of the dye from the fabric materials;

e. a recovering means for recovering excess of the dye from the fabric materials; and f. a dyeing process halting means for halting the dyeing process and aiding in fixing the dye on the fabric; wherein said dye bath means, said dyeing means, said removal means, said recovering means and said dyeing process halting means are open to the atmosphere.

2. An apparatus for dyeing fabric materials in which steam fixation of the dye onto the fabric materials is unnecessary, comprising:

a. a dye bath means containing a dye having a boiling point greater than 212° F.;

b. a heating means adjacent to said dye bath means which heats the dye within said dye bath means to a temperature greater than 212° F. at standard temperature and pressure;

c. a dyeing means immersed in the dye within said dye bath means for applying the dye to the fabric materials;

d. a removal means for removing excess of the dye from the fabric materials;

e. a recovering means for recovering excess of the dye from the fabric materials;

f. a preheating means to preheat the fabric materials to a temperature of up to about 220° F., wherein said preheating means is located prior to said dye bath means and adjacent to the fabric materials; and g. a dyeing process halting means for halting the dyeing process and aiding in fixing the dye of the fabric; wherein said dye bath means, said dyeing means, said removal means, said recovering means, said preheating means and said dyeing process halting means are open to the atmosphere.

3. The dyeing apparatus as described in claim 2 further comprising a dye mixing means and a dye heating means, said dye mixing means comprising means for introducing the dye to said dye heating means, said dye mixing means being located prior to said means for introducing the dye to the dye bath means, and said dye heating means being located prior to said dye bath means.

4. The dyeing apparatus as described in claim 3, wherein said removal means being located downline from said dyeing means.

5. The dyeing apparatus as described in claim 4, wherein said means for recovering excess of the dye from the fabric materials being a vacuum means, said vacuum means being located downline from said removal means.

6. The dyeing apparatus as described in claim 5, further comprising recycle means for recycling said recovered excess dye to said mixing means.

7. The dyeing apparatus as described in claim 5, further comprising washing means for washing the fabric materials, said washing means being located downline from said vacuum means.

8. The dyeing apparatus as claimed in claim 1, wherein said dye is a dye solution comprising dye, dyeing assistants, acid and water said dye being selected from the group consisting of acid dyes; said dyeing assistants being selected from the group consisting of alcohols, glycols, glycerols and ionic surfactants, and coconut condensate; and said acid being sulfamic acid.

9. The dyeing apparatus as described in claim 2, wherein said preheating means is co-extensive with said heating means.

10. The dyeing apparatus as described in claim 2, wherein said preheating means is separate for said heating means.

11. The dyeing apparatus as described in claim 2, further comprising a fabric materials preheating zone located prior to said dye bath means, the fabric materials being preheated within said preheating zone by said preheating means.

12. The dyeing apparatus as described in claim 2, wherein said recovering means is located subsequent to said removal means relative to said dye bath means.

13. The dyeing apparatus as claimed in claim 2, wherein said dye is a dye solution comprising dye, dyeing assistants, acid and water; said dye being selected from the group consisting of acid dyes; said dyeing assistants being selected from the group consisting of alcohols, glycols, glycerols and ionic surfactants, and coconut condensate; and said acid being sulfamic acid.

* * * * *